US012698181B2

(12) United States Patent
Renaud et al.

(10) Patent No.: US 12,698,181 B2
(45) Date of Patent: Aug. 4, 2026

(54) REEL ASSEMBLY AND METHODS OF USE THEREOF

(71) Applicant: Polaris Industries Inc., Medina, MN (US)

(72) Inventors: Benoit Renaud, Elkhart, IN (US); Erik Rogers, Bristol, IN (US); Kristian E. Nelson, Elkhart, IN (US)

(73) Assignee: POLARIS INDUSTRIES INC., Medina, MN (US)

( * ) Notice: Subject to any disclaimer, the term of this patent is extended or adjusted under 35 U.S.C. 154(b) by 217 days.

(21) Appl. No.: 18/371,521

(22) Filed: Sep. 22, 2023

(65) Prior Publication Data

US 2024/0132324 A1 Apr. 25, 2024
US 2024/0228225 A9 Jul. 11, 2024

Related U.S. Application Data

(60) Provisional application No. 63/417,399, filed on Oct. 19, 2022.

(51) Int. Cl.
*B63B 34/50* (2020.01)
*B65H 75/28* (2006.01)
(Continued)

(52) U.S. Cl.
CPC ..... *B65H 75/425* (2013.01); *B63B 34/50* (2020.02); *B65H 75/285* (2013.01); *B65H 75/4486* (2013.01); *B65H 75/4494* (2013.01)

(58) Field of Classification Search
CPC ..... B65H 75/285; B65H 75/425; B65H 75/4486; B65H 75/4494; B63B 34/50; B63B 34/52; B63B 2029/022
See application file for complete search history.

(56) References Cited

U.S. PATENT DOCUMENTS 4,467,978 A * 8/1984 Farrington ..... E04H 4/101 4/502
10,370,219 B2 * 8/2019 Neuharth ..... B65H 75/4494
(Continued)

OTHER PUBLICATIONS

The Matt Rack, https://www.themattrack.com/product-page/the-matt-rack-1, webpage, May 19, 2022.
(Continued)

*Primary Examiner* — Sang K Kim
(74) *Attorney, Agent, or Firm* — SCHWEGMAN LUNDBERG & WOESSNER, P.A.

(57) ABSTRACT

A reel system may receive a leading edge of a flexible buoyant pad. The flexible buoyant pad may have a use configuration having a first outer vertical envelope and a storage configuration having a second outer vertical envelope that is smaller than the first outer vertical envelope. The reel system may comprise at least one base member, an arm rotatably coupled to the base member and a rotatable axle coupled to the arm. The rotatable axle may be rotatable relative to the arm and the rotatable axle may adapted to receive the flexible buoyant pad and support the flexible buoyant pad in the storage configuration. Further, an actuatable input may supported by the arm. The actuatable input may be configured to rotate the rotatable axle relative to the arm.

22 Claims, 11 Drawing Sheets

(51) Int. Cl.
*B65H 75/42* (2006.01)
*B65H 75/44* (2006.01)

(56) References Cited

U.S. PATENT DOCUMENTS 10,668,991 B1 * 6/2020 Champlin ..... B63B 29/00
10,703,600 B2 * 7/2020 Behrendt ..... B65H 75/285

OTHER PUBLICATIONS

Roll A Mat Foam Floating Mat, Roll A Matt, https://www.youtube.com/watch?v=IgUQMKcOtCM, video, Jul. 26, 2017, 4 Screenshots: (0:13, 0:25, 0:35, 2:20).
Manta Racks, Rack Systems, https://www.mantaracks.com/product-category/rack-systems/, webpage, Jan. 22, 2022.

* cited by examiner

REEL ASSEMBLY AND METHODS OF USE THEREOF

CROSS-REFERENCE TO RELATED APPLICATION

The present application claims the benefit of U.S. Provisional Ser. No. 63/417,399, filed Oct. 19, 2022, entitled "REEL ASSEMBLY AND METHODS OF USE THEREOF", the entire disclosure of which is incorporated herein.

FIELD OF THE DISCLOSURE

The present disclosure relates to a reel assembly, methods of storing a reel assembly, and associated uses thereof.

BACKGROUND OF THE DISCLOSURE

Flexible buoyant water pads are bulky and require unique storage solutions and methods of transporting them. Accessories that are made for use on bodies of water are often heavy and difficult to transport, and methods of putting them into the water and storing while out of the water are limited.

SUMMARY OF THE DISCLOSURE

In one embodiment of the present disclosure, a reel system is provided. The reel system is configured for receiving a leading edge of a flexible buoyant pad having a use configuration with a first outer vertical envelope and a storage configuration with a second outer vertical envelope. The second outer vertical envelope is smaller than the first outer vertical envelope. The reel system comprises at least one base member, an arm rotatably coupled to the base member and a rotatable axle coupled to the arm. The rotatable axle is rotatable relative to the arm and adapted to receive the flexible buoyant pad and support the flexible buoyant pad in the storage configuration. An actuatable input is supported by the arm and configured to rotate the rotatable axle relative to the arm.

In various embodiments, the single base member is a first base member and the arm is a first arm. The reel system further comprises a second base member spaced from the first base member and a second arm is rotatably coupled to the second base member. Further, the rotatable axle extends between the first arm and the second arm. In various embodiments, the reel system further comprises a support plate extending laterally between and coupled to the first base and the second base.

In various embodiments, the rotatable axle is removably coupled to the arm.

In various embodiments, the reel system further comprises a mounting fixture, and the mounting fixture is supported by the base member.

In various embodiments, the reel system further comprises a support coupled to the base. The support is shaped to receive the flexible buoyant pad and the support also comprises an aperture configured to receive a strap. Further, the support is a first support and the reel system further comprises a second support coupled to a second base. The second support is shaped to receive the rolled up pad and the second support comprises a second aperture configured to receive a second strap.

In various embodiments, the actuatable input comprises a motor configured to rotate the rotatable axis.

In various embodiments, the actuatable input comprises a crank arm.

In various embodiments, the arm is configured to rotate between a first position when the flexible buoyant pad is in the use configuration and a second position when the flexible buoyant pad is in the storage configuration. Further, the second position is distinct from the first position.

In various embodiments, the rotatable axle comprises a first member and a second member spaced from the first member and the pad is configured to extend between the first member and the second member.

In yet another embodiment of the present disclosure, an accessory mounting structure is provided. The accessory mounting structure comprising a mounting panel configured to mount to a vehicle and an accessory mounting structure supported by the mounting panel. The accessory mounting structure is further configured to receive an accessory. The accessory mounting system further comprises a linkage assembly coupled between the mounting panel and the accessory mounting platform. The linkage assembly also comprises a first member and a second member each configured to rotate relative to the mounting panel. Further, the linkage assembly is adapted to move between a first position and a second position. In the first position the mounting structure is nominally parallel to a ground level and in the second position the mounting structure is angled upwardly from the first position.

In various embodiments, the linkage assembly further comprises a third link coupled between the first link and the second link. Further, the third link is a biasing member. In various embodiments, the accessory mounting system further comprises a fourth link coupled between the first link and the second link. The fourth link is positioned further from the mounting panel than the third link.

In various embodiments, the mounting panel mounts to the vehicle using a plurality of removable mounting fixtures.

In various embodiments, the accessory mounting system further comprises a motor coupled to the linkage assembly and the motor is configured to move the linkage assembly from the first position to the second position.

DETAILED DESCRIPTION OF THE DRAWINGS

Figure 1:
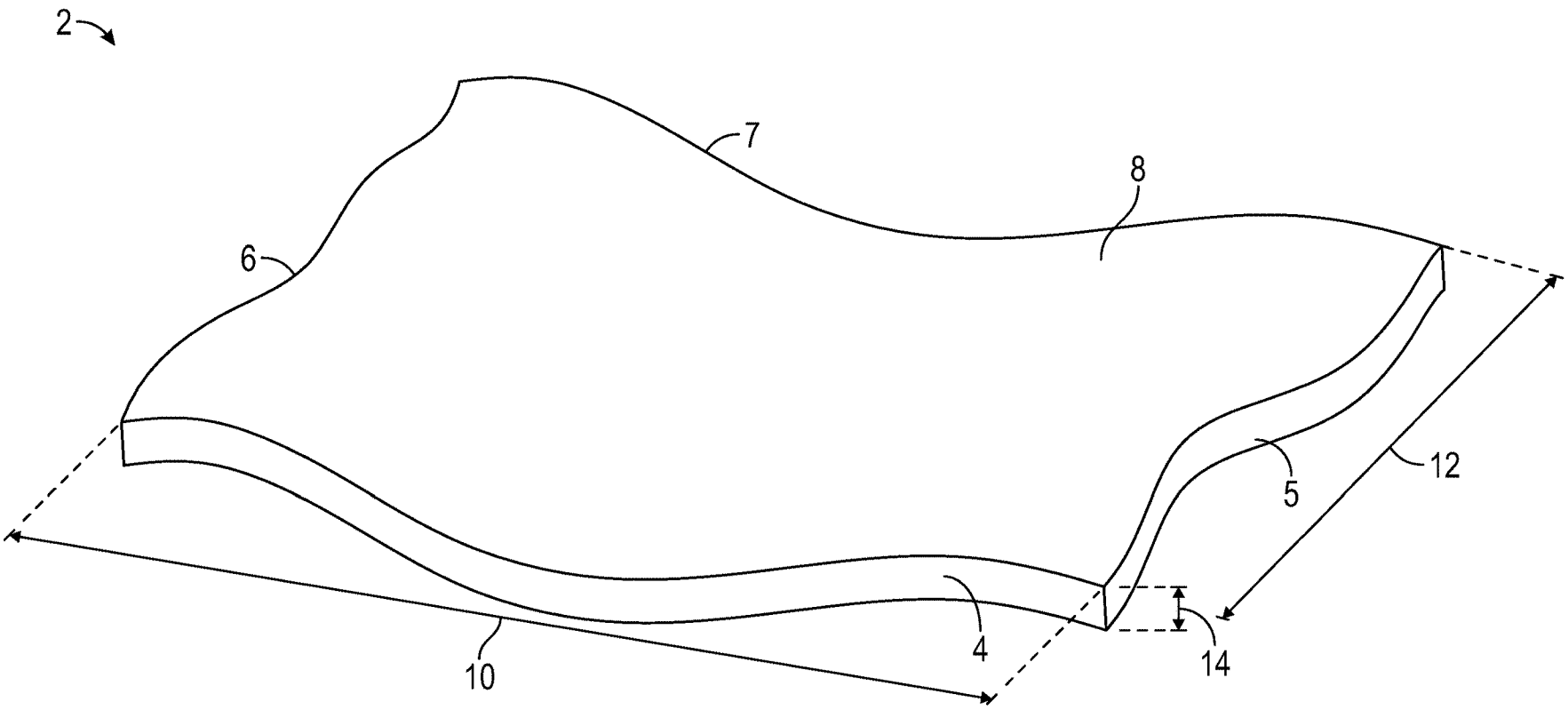
FIG. 1 is a perspective view of a flexible buoyant pad of the present disclosure in a deployed, unrolled position.

For the purposes of promoting an understanding of the principles of the present disclosure, reference is now made to the embodiments illustrated in the drawings, which are described below. The embodiments disclosed below are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler", and variations thereof are used to include both arrangements wherein two or more components are in direct physical contact and arrangements wherein the two or more components are not in direct contact with each other (e.g., the components are "coupled" via at least a third component, but yet still cooperates or interact with each other).

In some instances throughout this disclosure and in the claims, numeric terminology, such as first, second, third, and fourth, is used in reference to various operative transmission components and other components and features. Such use is not intended to denote an ordering of the components. Rather, numeric terminology is used to assist the reader in identifying the component being referenced and should not be narrowly interpreted as providing a specific order of components.

Referring to FIG. 1, a flexible buoyant pad 2 comprises a first edge surface 4 spaced from a second edge surface 7. First edge surface 4 and second edge surface 7 are coupled by a third edge surface 5 and a fourth edge surface 6. Edges 4, 7 have a length 10, edges 5, 6 have a width 12, and edges 4, 5, 6, 7 have a height, or thickness 14. Pad 2 has a surface 8 defined by the profile created by edges 4, 5, 6, 7. In the embodiment of FIG. 1, pad 2 is in an unrolled, or deployed first position and has a first profile defined by length 10, width 12, and height, or thickness 14. The first profile has a profile area equal to the length 10 multiplied by the width 12 for a rectangular pad 2. That is, in the deployed first position, pad 2 has a first vertical envelope defined by the length 10 and the width 12. In embodiments, pad 2 has non-rectangular shape and the profile of pad 2 is comprised of all of the side surfaces.

Figure 2:
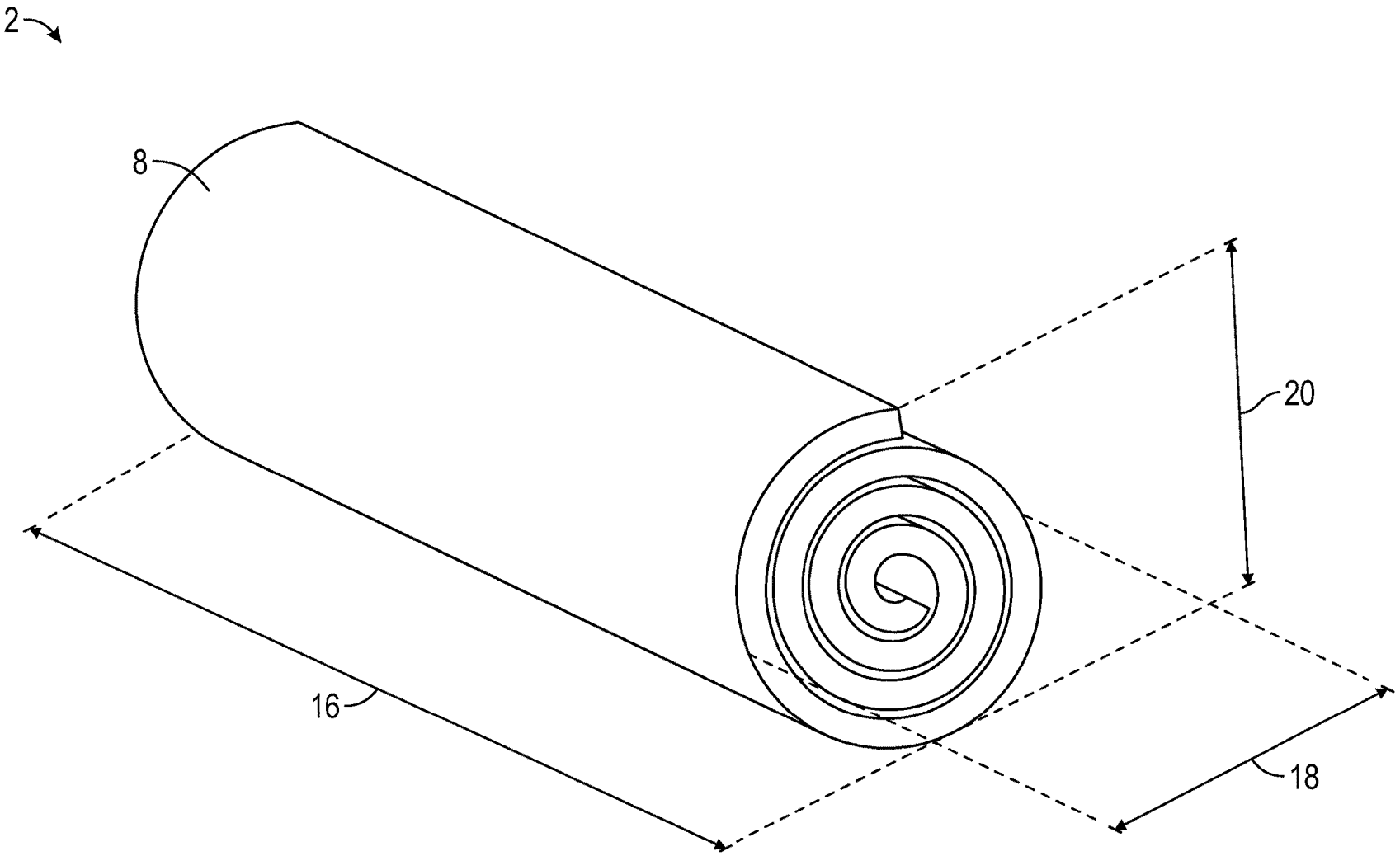
FIG. 2 is a perspective view of the flexible buoyant pad of FIG. 1 in a stored, rolled up position.
Figure 3:
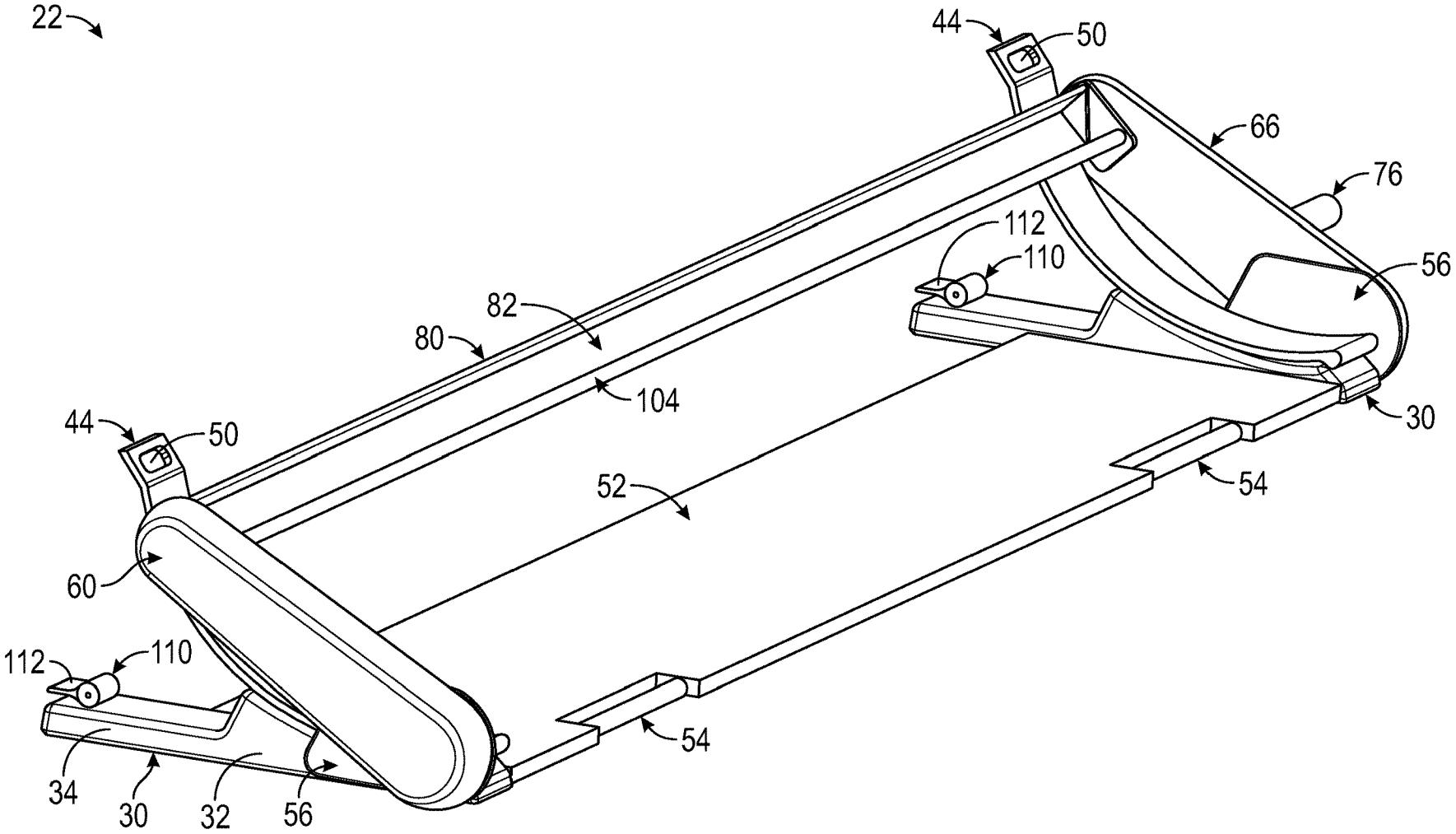
FIG. 3 is a top perspective view of a reel assembly of the present disclosure.
Figure 4:
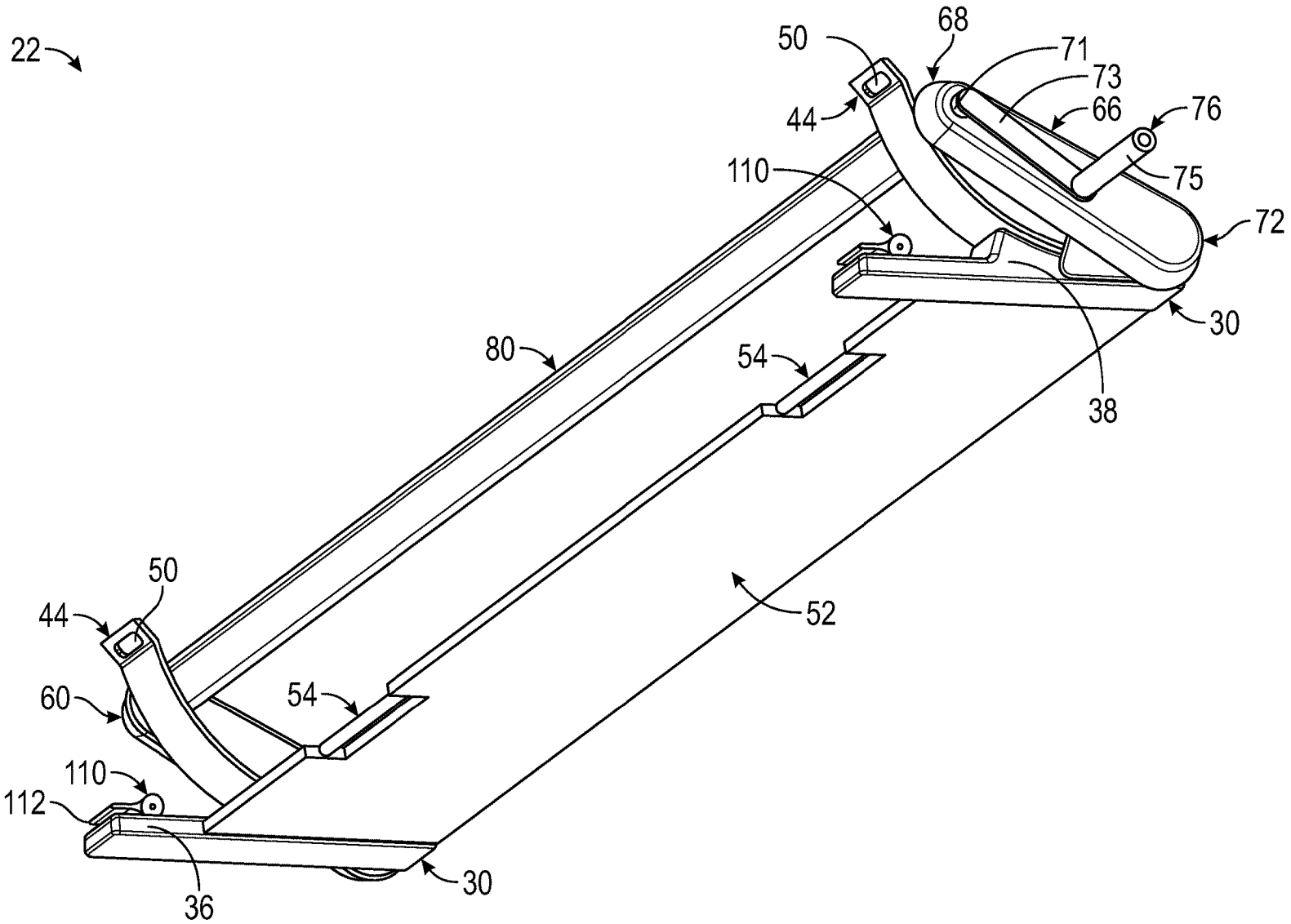
FIG. 4 is a bottom perspective view of the reel assembly of FIG. 3.
Figure 5:
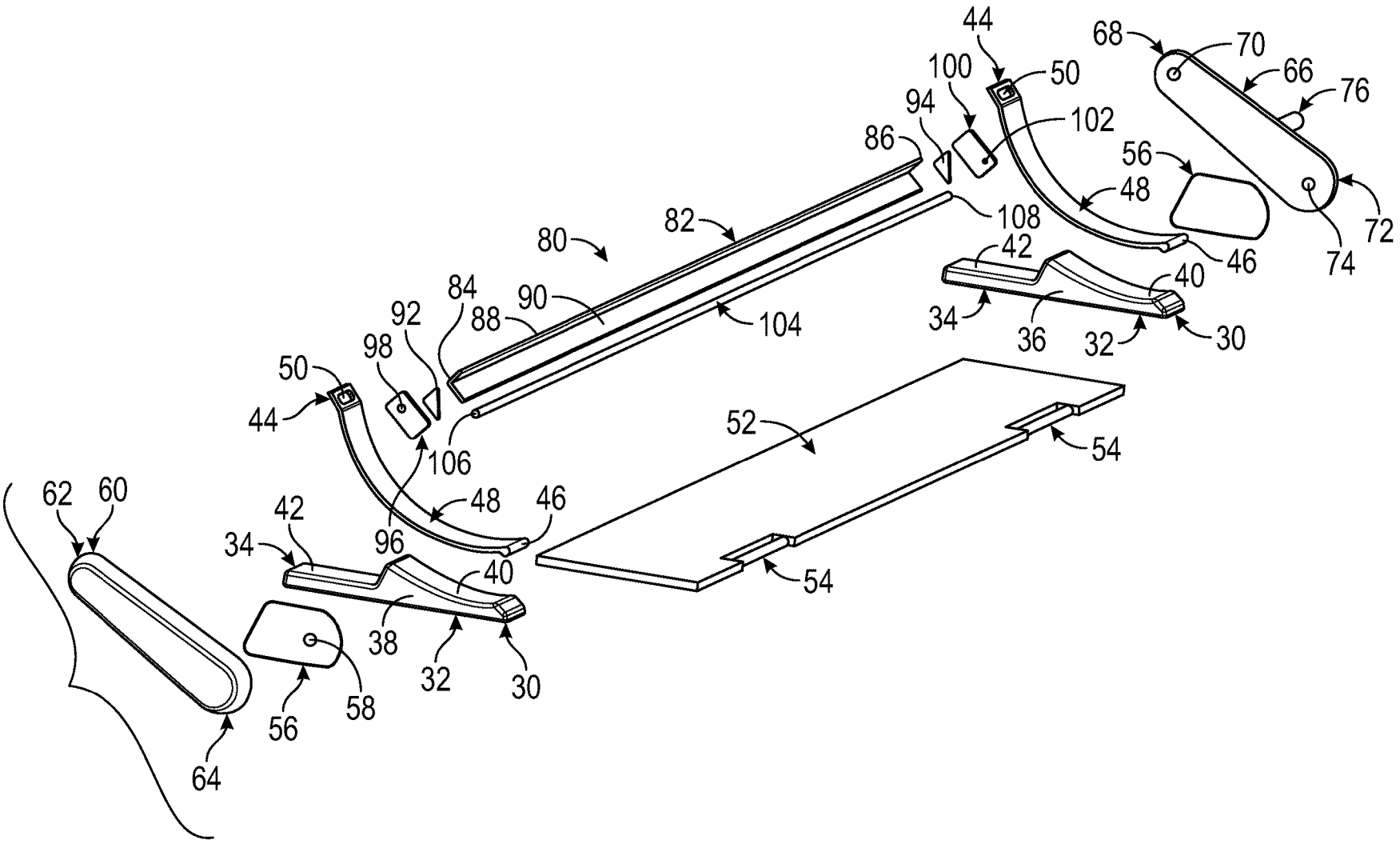
FIG. 5 is an exploded view of the reel assembly of FIG. 3.
Figure 6:
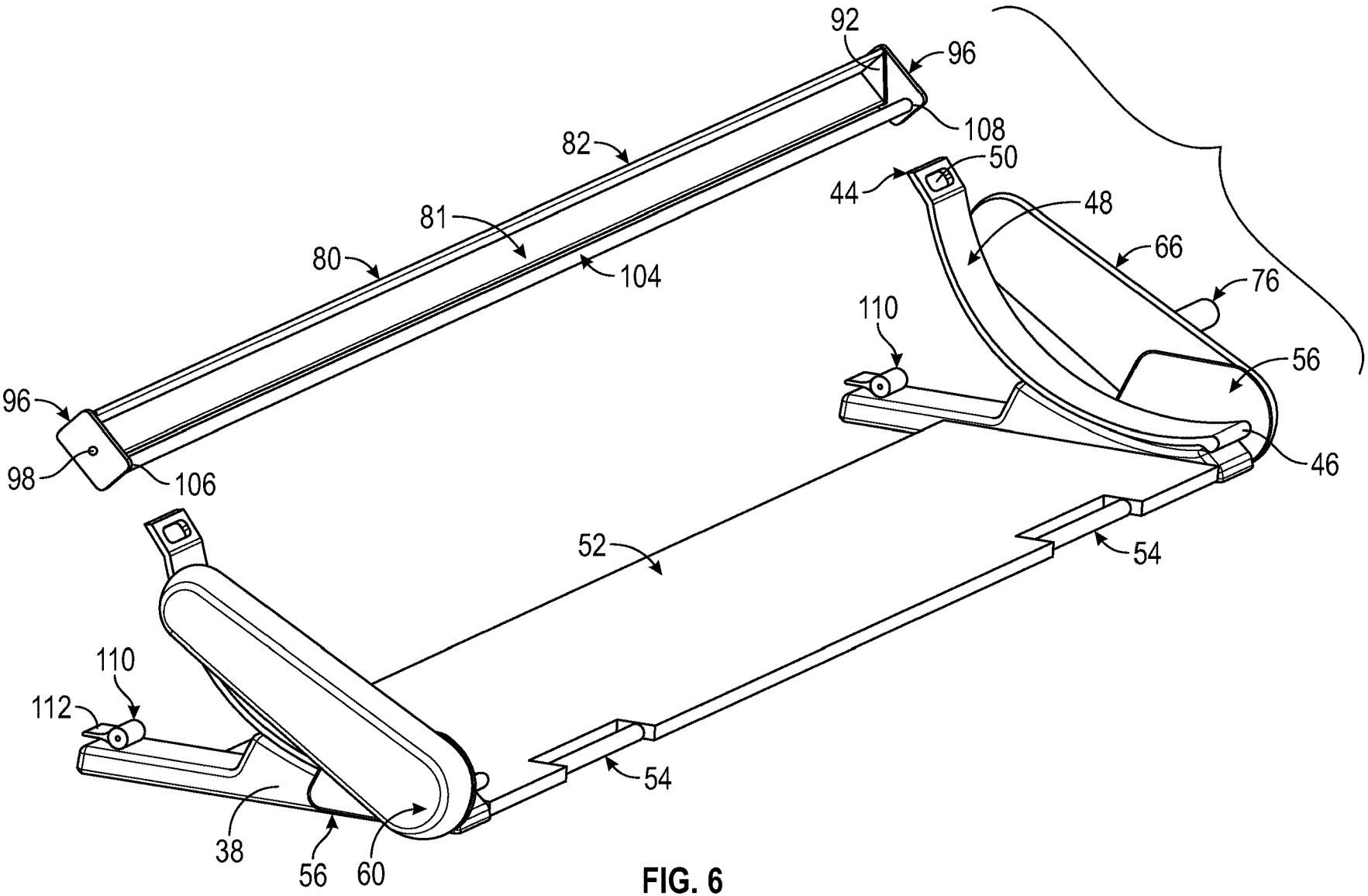
FIG. 6 is a perspective view of the reel assembly of FIG. 3 with the axle assembly exploded away.

Now referring to FIG. 2, flexible buoyant pad 2 is shown in a rolled, or stored second position and has a second profile that is smaller than the first profile. Illustratively, second profile is defined by a second length 18, a second width 16, and a second height 20. In the present embodiment, second width 16 is equal to first width 12. That is, when moving from the first position to the second position, either of edges 5, 6 is rolled up upon itself and the length of pad 2 is reduced form the first length 10 to the second length 18. The second profile has a profile area equal to the length 18 multiplied by the width 16. That is, in the rolled second position, pad 2 has a second vertical envelope defined by the length 18 and the width 16. The second vertical envelope is smaller than the first vertical envelope.

Figure 9:
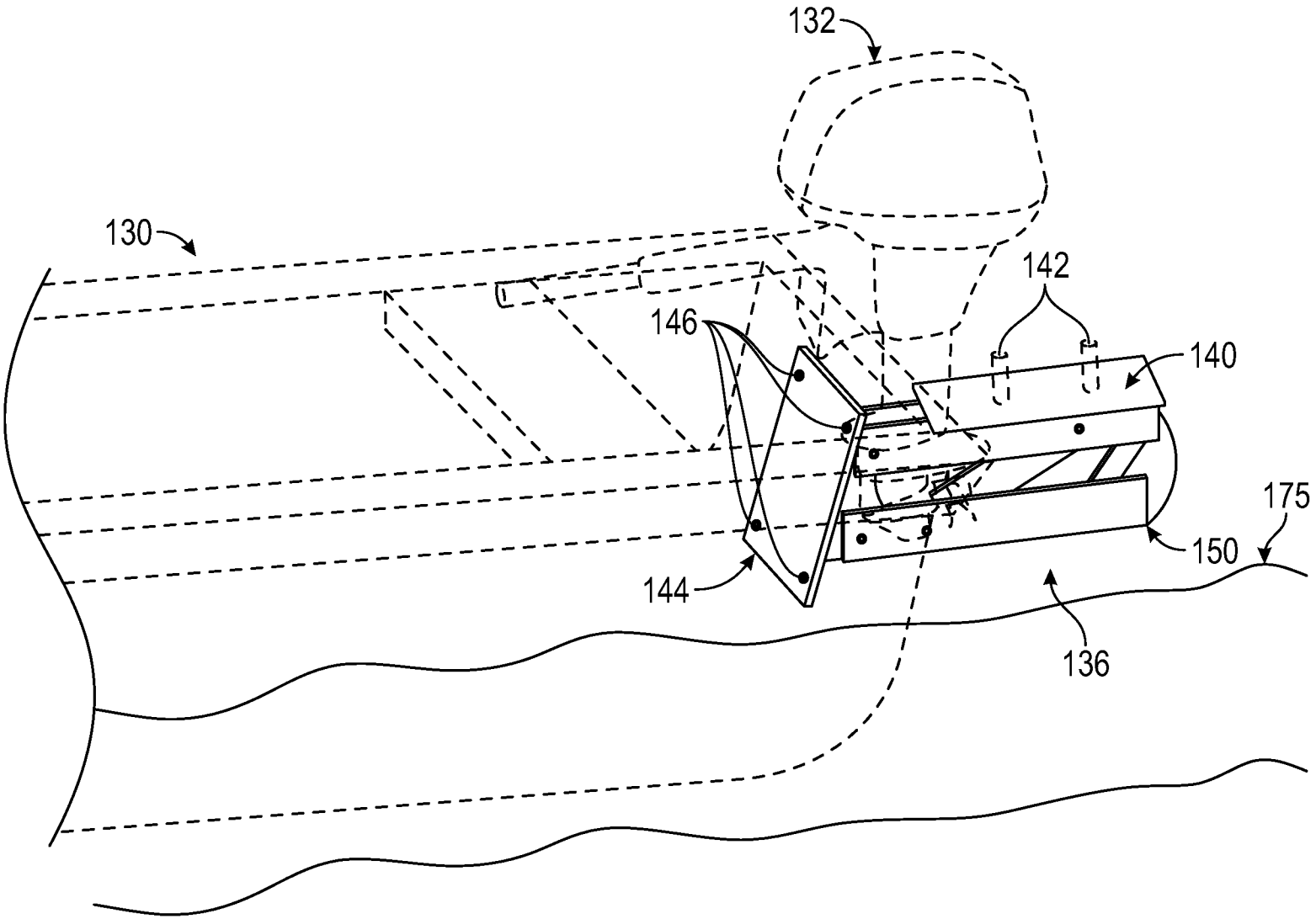
FIG. 9 is a perspective view of an accessory mounting assembly of the present disclosure mounted on a representative vehicle.

In the present embodiment, buoyant pad 2 is configured to float on a water surface 175 (FIG. 9). Buoyant pad 2 may be configured to support a person, an animal, a cooler, or a plurality thereof. Pad 2 may be kept close to a dock or a boat (i.e., tethered to the dock or boat) and may be in a stored position or a deployed position. Pad 2 may be kept in a stored position when not in use, or when a boat is in motion. Pad 2 may be in a deployed position when being used by a user or operator.

Referring to FIGS. 3-6, a reel system 22 is provided for storing, unloading, and transporting rollable water pad 2. Reel system 22 comprises a pair of bases 30 laterally spaced apart from one another. Each base 30 comprises a first portion 32 and a second portion 34, an inner face 36 and outer face 38. First portion 32 comprises a first portion upper face 40 that is generally arcuately shaped. Second portion 34 extends forwardly (i.e., outwardly) from first portion 32 and comprises a second portion upper face 42 which is nominally planar and horizontal to a ground level. First portion upper face 40 arcs generally upwardly and forwardly towards second portion 34. In various embodiments, reel system 22 comprises a single base 30.

Reel system 22 also comprises a support board, or support plate 52 extending between each of bases 30. In various embodiments, support board 52 is fixed to bases 30. In various embodiments, support board 52 is removably coupled to bases 30. In various embodiments, support board 52 is coupled to bases 30 using a fastener such as a screw, a bolt, a nail, a rivet, or another type of fastener. In various embodiments, support board 52 is coupled to bases 30 using an adhesive, hook-and-loop fasteners, a weld, a plastic weld, or by another type of coupling method. Further, in the present embodiment, support board 52 comprises a pair of handles 54 configured to allow a user to grasp the handle to carry reel system 22. Support board 52 may also be selectively removed from reel system 22 to allow a user to transport reel system 22 in pieces or change the distance between bases 30. In various embodiments, bases 30 and support board 52 are an integral, single piece. In various embodiments, reel system 22 comprises a pair of bases 30 and no support board 52. In various embodiments, reel system 22 comprises a single base 30 and no support board 52.

Reel system 22 also comprises a pair of support plates 56 positioned on outer face 38 of each base 30. Support plates 56 are coupled to bases 30 by an adhesive, a fastener, or another method of coupling. In the present embodiment, support plate 56 comprises a rotational support 58 positioned on an outer face thereof. Reel system 22 also comprises a first arm 66 and a second arm 60. First arm 66 comprises a generally semicircular first end 68 and a generally semicircular second end 72. Illustratively, first end 68 is smaller than second end 72. That is, first end 68 has a generally smaller radius than second end 72. First end 68 comprises a first aperture 70 on its inner face, and second end 72 comprises a rotational interface 74. Rotational interface 74 is configured to rotatably couple with rotational support 58 such that first arm 66 can rotate upwardly and downwardly relative to support plate 56, and thereby base 30.

Reel system 22 also comprises second arm 60 positioned opposite first arm 66. Second arm 60 is shaped identically to first arm 66. That is, second arm 60 comprises a generally semicircular first end 62 and a generally semicircular second end 64. Illustratively, first end 62 is smaller than second end 64. That is, first end 62 has a generally smaller radius than second end 64. First end 62 comprises a first aperture (not shown) on its inner face, and second end 64 comprises a rotational interface (not shown) substantially similar to rotational interface 74, and is configured to rotatably couple with rotational support 58 such that second arm 60 can rotate upwardly and downwardly relative to support plate 56, and thereby base 30.

In various embodiments, one of, or both of, first arm 66 and second arm 60 comprises a torsion spring (not shown) configured to assist in the rotation of first arm 66 and second arm 60 relative support plates 56. In various embodiments, a shock absorber, a spring, or other type of linear force element (not shown) extends between first arm 66 and one of the bases 30 and between second arm 60 and the other of the bases 30.

Still referring to FIGS. 1-4, reel system 22 comprises a pair of pad supports 44. Supports 44 are generally arcuately shaped and configured to interface with at least a portion of first portion upper face 40. In the present embodiment, supports 44 extend forwardly and upwardly from first portion upper face 40. In the present embodiment, support 44 may have an identical radius as the arcuate shape of first portion upper face 40. In the present embodiment, each of support 44 includes a pin structure 46. Pin structure 46 is generally positioned on a first end of support 44 adjacent first portion upper face 40. Pin structure 46 comprises a pin (not shown) positioned within a slot (not shown) wherein the pin is configured to rotatably couple to support plates 56. That is, supports 44 are rotatable relative to support plates 56. In various embodiments, supports 44 are fixedly coupled to support plates 56. Supports 44 also comprise an eyelet 50 on a second end of support 44 opposite the pin structure 46. Eyelet 50 is generally rectangularly shaped and configured to receive a strap 120, 122 (FIG. 7A) capable of wrapping around buoyant pad 2. In various embodiments, strap 120, 122 is a rope, or belt, or other looping mechanism.

Reel system 22 further comprises a rotatable axle 80 extending between first arm 66 and second arm 60. Rotatable axle 80 comprises a bracket, or first member 82 and a rod, or second member 104 spaced apart from one another. Illustratively, bracket 82 comprises a first end 84 configured to couple to second arm 60 and a second end 86 configured to couple to first arm 66. In the present embodiment, bracket 82 is a right-angle bracket configured with a first extension 88 and a second extension 90. In various embodiments, bracket 82 is an extruded bracket, and in yet other embodiments, bracket 82 is a bent bracket. A first endcap 92 is coupled to the first end 84 and is generally triangularly shaped and a second endcap 94 is coupled to the second end 86 and is generally triangularly shaped. First end 84 is coupled to a first coupling plate 96 through first endcap 92 and second end 86 is coupled to a second coupling plate 100 through second endcap 94. Coupling plate 100 comprises an inner coupling point 102 facing generally inwardly and coupling plate 96 comprises an inner coupling point (not shown) similar to inner coupling point 102 facing generally inwardly. Rod 104 comprises a rod first end 106 coupled to inner coupling point of first coupling plate 96 adjacent first end 84 and a rod second end 108 is coupled to inner coupling point 102 of the second coupling plate 100 adjacent second end 86. Rod 104 is spaced from bracket 82 such that an opening 81 (FIG. 6) is created between rod 104 and bracket 82 that spans the length of rotatable axle 80.

In various embodiments, reel assembly 22 comprises a non-continuous rod 104, such that rod 104 is effectively a guide for pad 2 as it is rolled or unrolled from rotatable axle 80. That is, a first section (not shown) of rod 104 extends outwardly from first coupling plate 96 and a second section (not shown) of rod 104 extends outwardly from second coupling plate 100 to allow pad 2 to rest on the first section and the second section.

In the present embodiment, first coupling plate 96 comprises an outer coupling point 98 configured to be rotatably coupled to second arm 60 at first end 62. Further, second coupling plate 100 comprises an outer coupling point (not shown, similar to outer coupling point 98) configured to be rotatably coupled to first arm 66 at a coupling point 70 adjacent first end 68. That is, rotatable axle 80 can be rotated relative to each of first arm 66 and second arm 60. In various embodiments, first aperture 70 comprises a bearing (not shown) configured to rotate within first aperture 70. Further, each outer coupling point 98 may be configured with an extension (not shown) configured to extend within the first aperture 70 and the corresponding aperture in second arm 60. That is, rotatable axle 80 is able to rotate about first arm 66 and second arm 60 by rotating within first aperture 70 and the corresponding aperture in second arm 60.

Figure 7A:
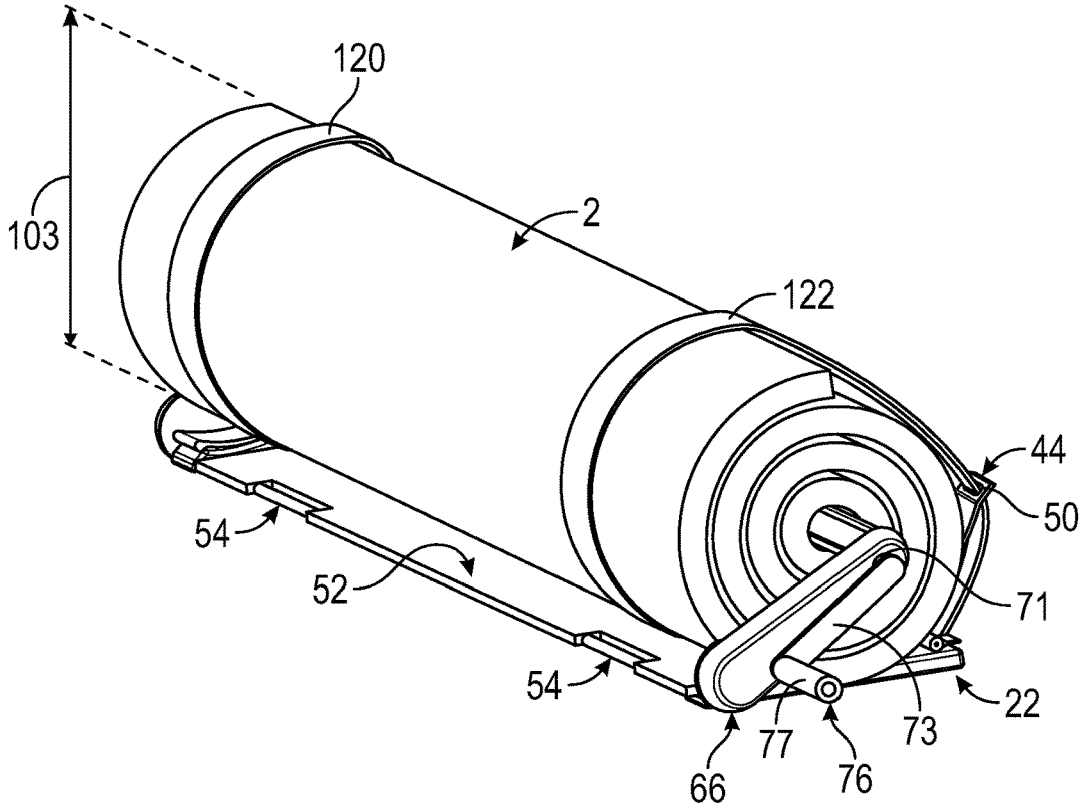
FIG. 7A is a perspective view of the reel assembly of FIG. 3 with the pad of FIG. 1 in a rolled state with a manual crank assembly.

Now referring to FIG. 7A, reel assembly 22 also comprises a crank assembly 76 coupled to first arm 66. Crank assembly 76 comprises a crank arm 73 and a handle 77 coupled to the crank arm 73. Crank arm 73 is coupled to first arm 66 at a rotational input coupling point 71. Rotational input coupling point 71 is positioned coincident with first aperture 70 on the outer facing side of first arm 66. Further, rotational input coupling point 71 is mechanically coupled to first aperture 70 such that a rotational input to rotational input coupling point 71 rotates first aperture 70 and a rotational input to first aperture 70 rotates rotational input coupling point 71. Crank assembly 76 may be rotated by a user input to handle 77 which subsequently provides a rotational input at each of rotational input coupling point 71 and first aperture 70. That is, a rotational input to crank assembly 76 provides a rotational input to rotatable axle 80.

Figure 7B:
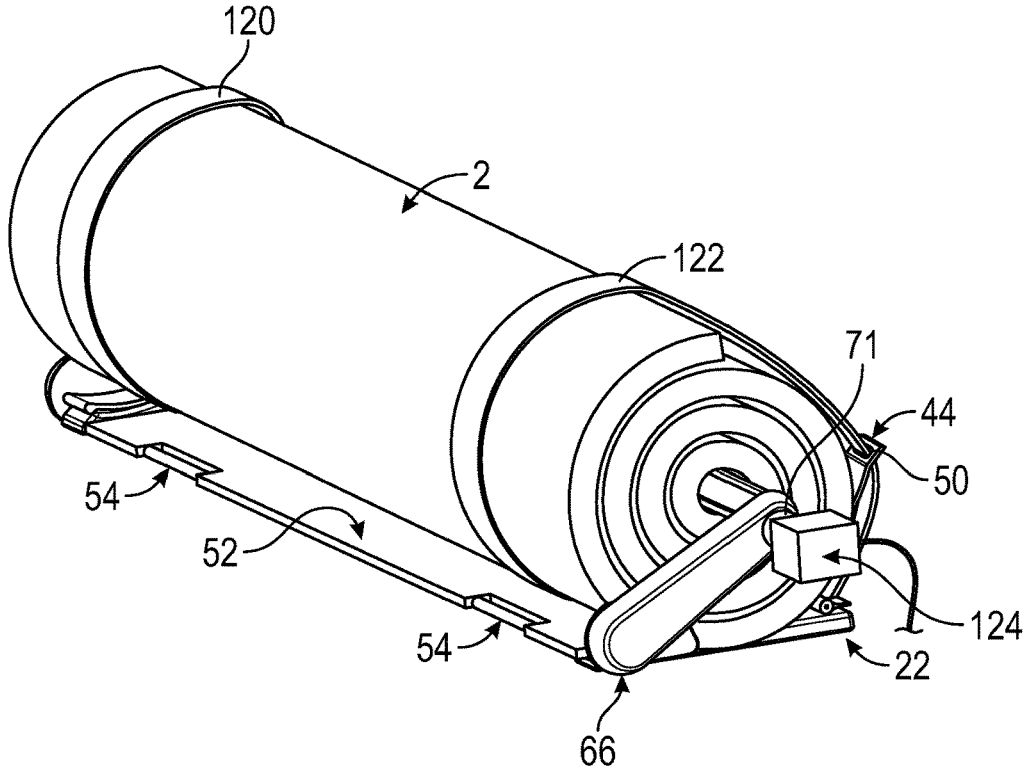
FIG. 7B is a perspective view of the reel assembly of FIG. 3 with the pad of FIG. 1 in a rolled state with a motorized crank assembly.

Referring now to FIG. 7B, reel assembly 22 may also comprises an actuatable electric motor 124 operably coupled to rotational input coupling point 71. Electric motor 124 may be a DC motor, an AC motor, a permanent magnet motor, an induction motor, a brushless motor, or another type of motor. Reel assembly 22 may comprise a user input (not shown) configured to provide instructions to a motor controller (not shown) to provide a forward or reverse rotational speed to motor 124. In one embodiment, motor 124 may be electronically coupled to a controller (not shown) configured to provide remote instructions from a mobile device. In various embodiments, motor 124 is electronically coupled to a vehicle 130 (FIG. 9). Vehicle 130 may include a plurality of user inputs (not shown) and an input to the vehicle user inputs provides instructions to the motor controller to provide a forward or reverse rotational speed to motor 124. Electric motor 124 may provide for an easier use of reel assembly 22 in rolling up or unrolling the rollable pad 2.

In various embodiments, reel assembly 22 comprises a second crank arm (not shown) positioned on second arm 60. The second crank arm is coupled to second arm 60 adjacent the coupling plate 96 and an input to either of crank arm 73 or the second crank arm will rotate rotatable axle 80. In various embodiments, reel assembly 22 comprises a second motor (not shown) coupled to second arm 60 configured to provide a rotational force to rotatable axle 80.

In the present embodiment, rotatable axle 80 is removably coupled to reel assembly 22. Each of first coupling plate 96 and second coupling plate 100 may be coupled to first arm 66 and second arm 60 through a pin and slot system, a latching mechanism, or another type of removable coupling system.

Figure 8:
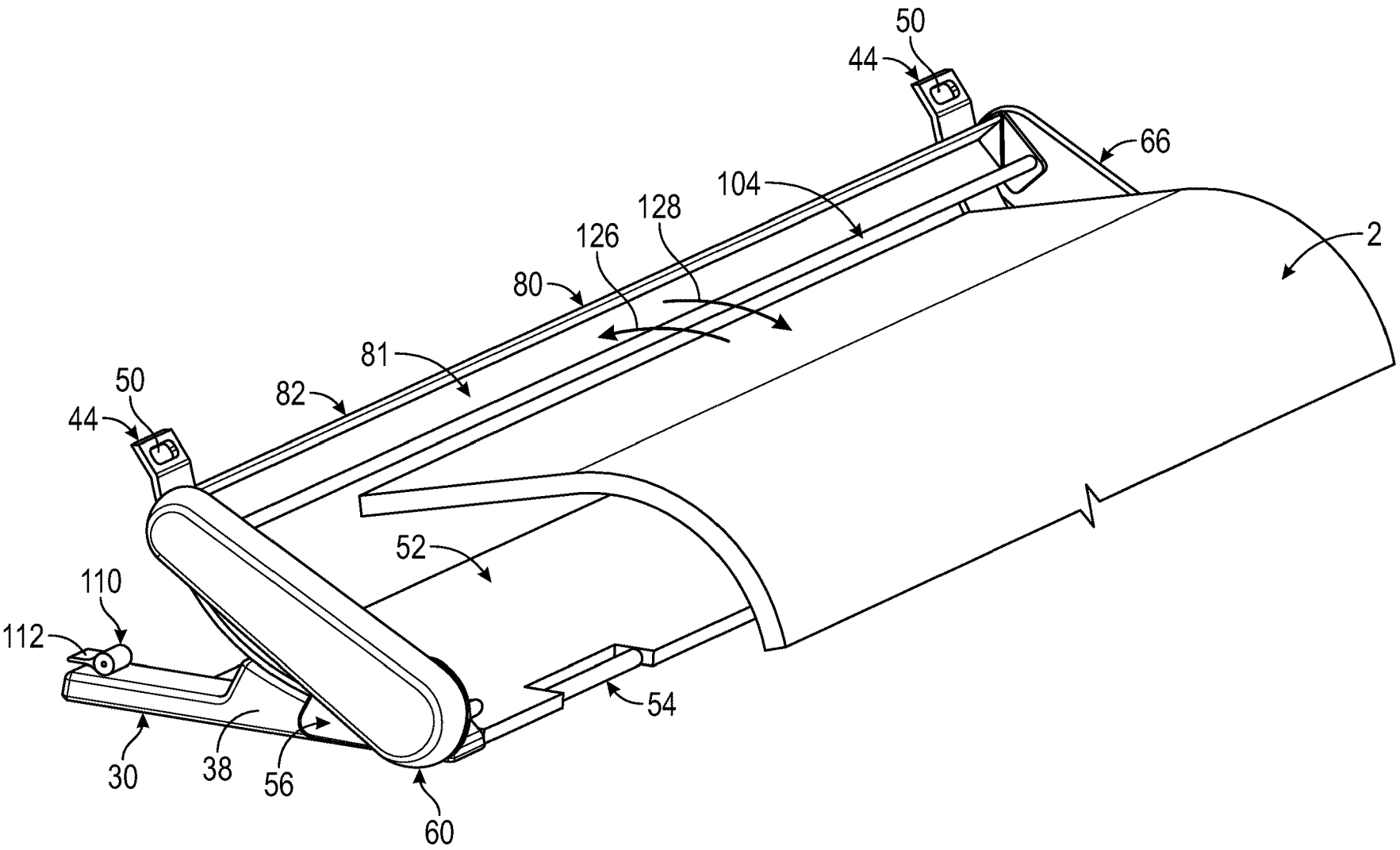
FIG. 8 is a perspective view of the reel assembly of FIG. 3 with the pad of FIG. 1 being removed and/or inserted into the axle assembly.

Referring now to FIGS. 7A-8, rollable pad 2 can be rolled onto reel assembly 22 and unrolled off of reel assembly 22. As shown in FIG. 8, a leading edge (e.g., any of edges 4, 5, 6, 7) of pad 2 can be inserted into opening 81 to engage pad 2 with rotatable axle 80. When pad 2 is engaged with rotatable axle 80, a rotational input to rotatable axle 80 will roll pad 2 around rotatable axle 80 so that pad 2 is in a stored position with a pad diameter 103. As pad 2 is rolled around rotatable axle 80 in rotational direction 126, pad diameter 103 increases and pad 2 becomes supported by supports 44. As more of pad 2 is rolled onto rotatable axle 80, pad diameter 103 increases and each of first arm 66 and second arm 60 is rotated generally upwardly. That is, when pad 2 is rolled completely onto axle 80, or in a stored position (FIG. 7A), each of first arm 66 and second arm 60 has a first arm position. Further, when pad 2 is unrolled completely off of axle 80, or in a deployed position (FIG. 8), each of first arm 66 and second arm 60 has a second arm position that is rotated generally downwardly from first arm position.

Further, pad 2 may be rolled off of reel assembly 22 by rotating axle 80 in rotational direction 128. As pad 2 is unrolled, pad diameter 103 decreases and each of first arm 66 and second arm 60 are rotated generally downwardly. When pad 2 is rolled on to reel assembly 22, pad 2 may be removed while it is on rotatable axle 80. That is, in a stored state (FIG. 7A), pad 2 may be moved and stored in a location separate from reel assembly 22. In one example, reel assembly 22 is positioned on a boat 130 (FIG. 9) and pad 2 is in a rolled up, stored condition. When a user is done using the pad 2, they may remove the pad 2 from the reel assembly 22 and boat 130 to bring the pad 2 to a better storage place (e.g., garage, shed, boat house, etc.). Further, when a user desires to use the pad 2, they can bring the pad 2 and rotatable axle 80 from the storage place to the reel assembly 22 on the boat 130.

Reel assembly 22 also comprises a plurality of mounting fixtures 110. Mounting fixtures 110 generally comprises a handle 112 configured to alter the fixture 110 between an engaged state and an unengaged state. When mounting fixture 110 is in an unengaged state, reel assembly 22 is removable and movable between various mounting locations. When reel assembly 22 is positioned in an appropriate position on a vehicle 130, or any other suitable location, mounting fixtures 110 can be altered into an engaged state to be fixed on vehicle 130 or another suitable location. In the present embodiment, reel assembly 22 may be positioned on a boat, a recreational vehicle, a utility vehicle, a jet-ski, a pontoon, a dock, a wall, or any other suitable location capable of storing rollable pad 2. Additional details regarding mounting fixtures 110 can be found in U.S. application Ser. No. 13/041,301, filed Mar. 4, 2011, titled VEHICLE EXPANSION RETAINER, and U.S. Application No. 63/357,204, filed Jun. 30, 2022, titled CARGO AREA FOR UTILITY VEHICLE, the entire disclosures of which are expressly incorporated herein by reference.

Figure 10A:
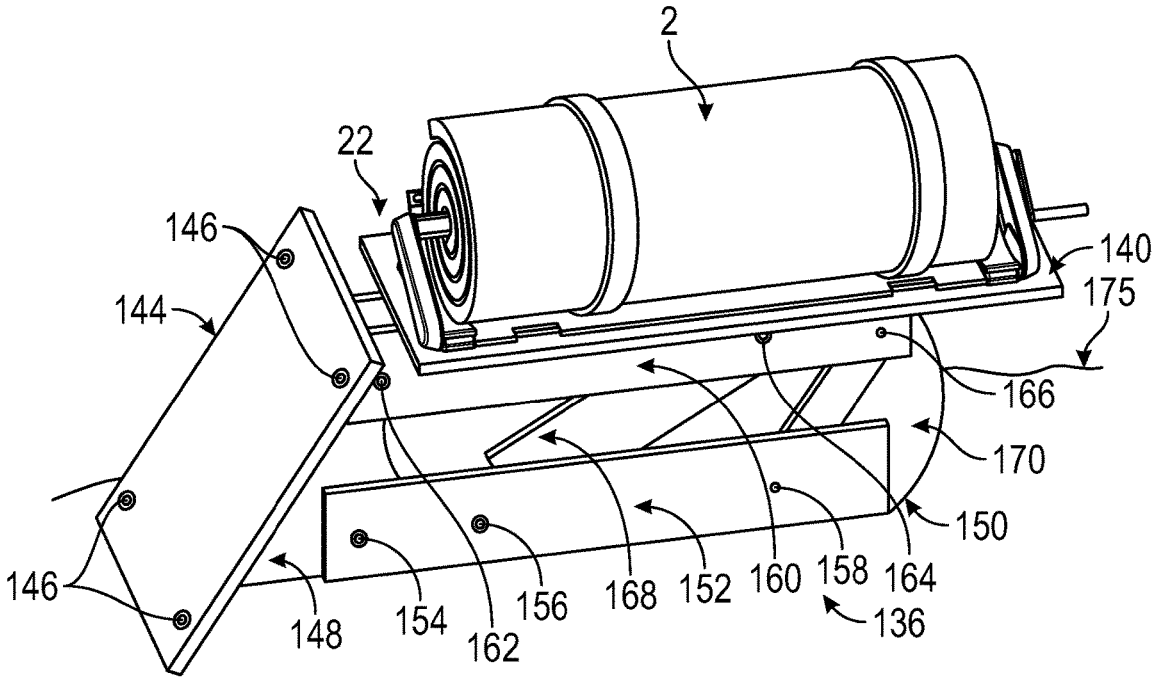
FIG. 10A is a perspective view of the accessory mounting assembly of FIG. 9 with the reel assembly of FIG. 7A mounted on it.
Figure 10B:
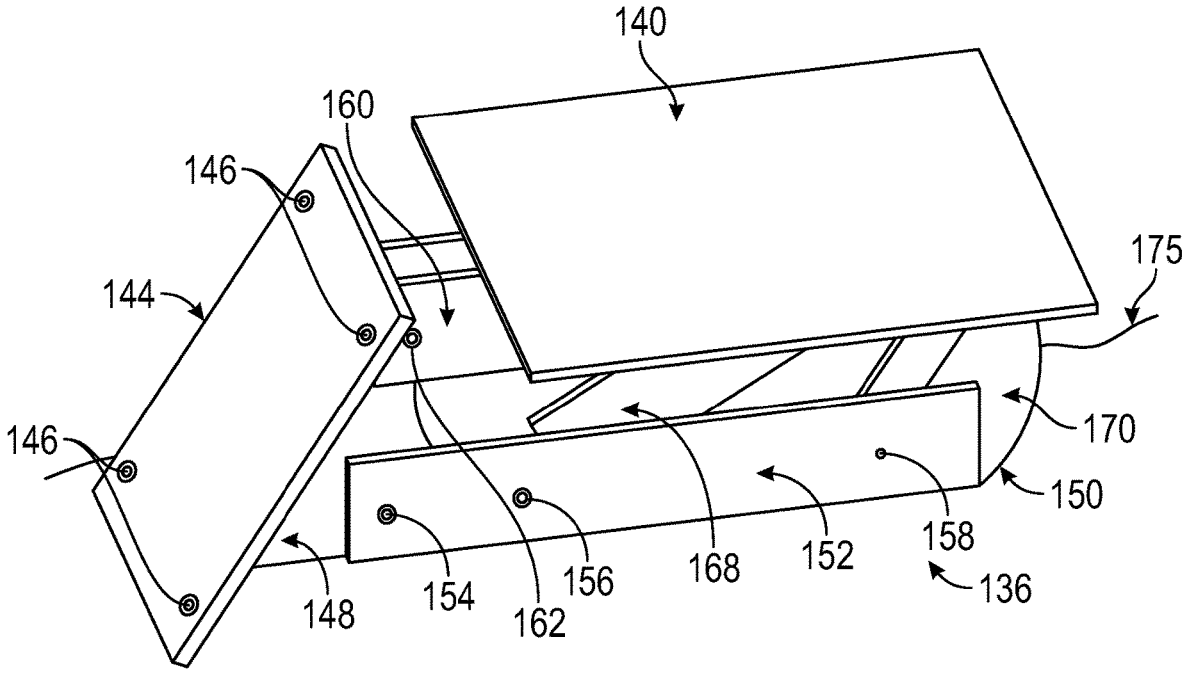
FIG. 10B is a perspective view of the accessory mounting assembly of FIG. 9 with an accessory platform.
Figure 11:
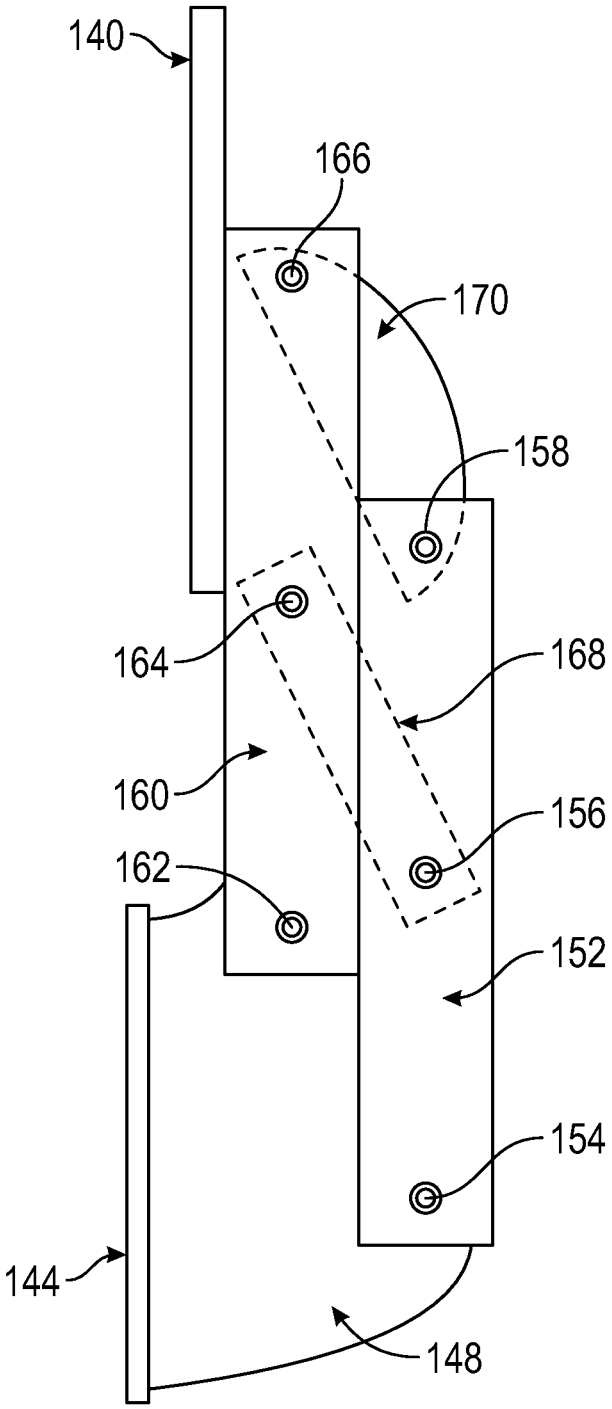
FIG. 11 is a side view of the accessory mounting assembly of FIG. 9 in a stored position.

Now referring to FIGS. 9-11, an accessory mounting system 136 is configured to couple to vehicle 130. In the present embodiment, vehicle 130 is a boat, or a pontoon. In various embodiments, vehicle 130 may be an automobile, a recreational vehicle, a utility vehicle. Mounting system 136 comprises a mounting panel 144 and an extension 148 extending outward from mounting panel 144. Mounting panel 144 couples to vehicle 130 using a plurality of fasteners 141 extending through mounting panel 144. In various embodiments, fasteners 141 are screws, bolts, or other types of fasteners. In various embodiments, mounting panel 144 is removably coupled to vehicle 130. In yet additional embodiments, mounting panel 144 is fixedly coupled to vehicle 130. In the present embodiment, extension 148 is integral with mounting panel 144. In various embodiments, extension 148 is removably coupled to mounting panel 144.

Accessory mounting system 136 further comprises an accessory mounting structure 140 and a linkage assembly 150 coupled between extension 148 and mounting structure 140. In the present embodiment, mounting structure 140 is a flat surface with a pair of accessory mounting members 142 configured to receive an accessory (not shown). In various embodiments, mounting structure 140 is a completely flat surface. In various embodiments, mounting structure 140 is a flat surface with a plurality of receiving apertures (not shown) for mounting fixtures 110. Linkage assembly 150 comprises a first member 152 rotatably coupled to extension 148 about a first rotation axis 154 and a second member 160 rotatably coupled to extension 148 about a second rotation axis 162. In the present embodiment, first member 152 and second member 160 extend nominally parallel to each other. A third link 168 extends between—and is rotatably coupled to each of—first member 152 and second member 160. Third link 168 is coupled to first member 152 at a first coupling point 156 and second member 160 at a second coupling point 164. Further, a fourth link 170 extends between—and is rotatably coupled to each of—first member 152 and second member 160. Illustratively, fourth link 170 is positioned further from mounting panel 144 than third link 168. Fourth link 170 is coupled to first member 152 at a third coupling point 158 and second member 160 at a fourth coupling point 166.

Linkage assembly 150 is constructed so that accessory mounting system 136 can rotate. That is, mounting structure 140 is configured to rotate, on linkage assembly 150, between a first position and a second position. In the present embodiment, mounting system 136 is configured to be positioned in a first position such that mounting structure 140 is generally parallel to a water level. Mounting system 136 is configured to rotate into a second position such that mounting structure 140 is generally perpendicular to the ground level. In the present embodiment, mounting system 136 is configured to rotate approximately 90 degrees. In various embodiments, mounting system 136 is configured to rotate to rotate 120 degrees, 150 degrees, or 180 degrees. In various embodiments, linkage assembly 150 may be configured with a plurality of discrete positions, such as a first position generally parallel (0 degrees) to a ground level, a second position generally perpendicular (90 degrees) to a ground level, a third position angled approximately 45 degrees upwardly from a ground level, and a fourth position angled approximately 30 degrees downwardly from a ground level. In various embodiments, an angle between 0-180 degrees may be used whether angled upwardly or downwardly from a ground level. In various embodiments, in the first position, at least a portion of mounting system 136 is positioned below the water surface 175. In various embodiments, in the second position, all of mounting system 136 is positioned above the water surface 175. In various embodiments, in the first position, mounting structure 140 is configured to sit below the water surface 175. In various embodiments, mounting structure 140 is configured to just above the water surface 175.

In various embodiments, mounting structure 140 is sized and shaped to receive reel assembly 22. In various embodiments, mounting structure 140 is configured to receive a plurality of other accessories, such as a slide, a pet ladder, a step ladder, or other type of accessory.

In various embodiments, accessory mounting system 136 may be configured such that linkage assembly 150 is assisted in rotating between the first position and the second position. That is, in various embodiments, either of third link 168 or fourth link 170 may be a biasing member, such as a shock absorber, a spring, or another type of linear force element. In various embodiments, linkage assembly 150 may comprise a biasing member in addition to third link 168 and fourth link 170. In various other embodiments, accessory mounting system 136 may comprise a motor (not shown) coupled to extension 148 about either of first rotation axis 154 or second rotation axis 162. The motor may be configured to electronically rotate mounting structure between the first position and the second position.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

The invention claimed is:

1. A reel system for receiving a leading edge of a flexible buoyant pad having a use configuration having a first outer vertical envelope and a storage configuration having a second outer vertical envelope smaller than the first outer vertical envelope, the reel system comprising:

a first base member;

a first arm rotatably coupled to the first base member;

a second base member spaced from the first base member;

a second arm rotatably coupled to the second base member;

a support plate extending laterally between and coupled to the first base member and the second base member;

a rotatable axle extending between the first arm and the second arm, the rotatable axle rotatable relative to the first arm and the second arm, the rotatable axle adapted to receive the flexible buoyant pad and support the flexible buoyant pad in the storage configuration; and an actuatable input supported by the first arm, the actuatable input configured to rotate the rotatable axle relative to the first arm and the second arm.

2. The reel system of claim 1, wherein the rotatable axle is removably coupled from the first arm and the second arm.

3. The reel system of claim 1, further comprising a mounting fixture, the mounting fixture supported by either of the first base member or the second base member.

4. The reel system of claim 1, further comprising a support coupled to the first base member, the support shaped to receive the flexible buoyant pad, the support comprising an aperture configured to receive a strap.

5. The reel system of claim 4, wherein the support is a first support, the reel system further comprising a second support coupled to the second base member, the second support shaped to receive the rolled up pad, the second support comprising a second aperture configured to receive a second strap.

6. The reel system of claim 1, wherein the actuatable input comprises a motor configured to rotate the rotatable axle.

7. The reel system of claim 1, wherein the actuatable input comprises a crank arm.

8. The reel system of claim 1, wherein the first arm and the second arm are configured to rotate between a first position when the flexible buoyant pad is in the use configuration and a second position when the flexible buoyant pad is in the storage configuration, the second position distinct from the first position.

9. The reel system of claim 1, wherein the rotatable axle comprises a first member and a second member spaced from the first member, and the flexible buoyant pad is configured to extend between the first member and the second member.

10. The reel system of claim 1, wherein the support plate comprises at least one handle configured to allow a user to carry the reel system.

11. The reel system of claim 1, wherein the rotatable axle comprises a bracket and a rod spaced apart from the bracket to define an opening therebetween, the opening extending along a length of the rotatable axle and configured to receive the leading edge of the flexible buoyant pad.

12. A reel system for receiving a flexible buoyant pad, the reel system comprising:

a base member;

a support plate supported by the base member, the support plate comprising a rotational support;

an arm having a first end and a second end, the first end being semicircular with a first radius and comprising a first aperture, the second end being semicircular with a second radius larger than the first radius and comprising a rotational interface, the rotational interface rotatably coupled to the rotational support such that the arm can rotate upwardly and downwardly relative to the base member;

a rotatable axle coupled to the arm at the first aperture, the rotatable axle rotatable relative to the arm, the rotatable axle adapted to receive the flexible buoyant pad and support the flexible buoyant pad in a storage configuration; and an actuatable input supported by the arm at a rotational input coupling point positioned coincident with the first aperture, the actuatable input mechanically coupled to the rotatable axle and configured to rotate the rotatable axle relative to the arm.

13. The reel system of claim 12, wherein the arm comprises a torsion spring configured to assist in rotation of the arm relative to the support plate.

14. The reel system of claim 12, wherein the base member is a first base member and the arm is a first arm, the reel system further comprising a second base member spaced from the first base member and a second arm rotatably coupled to the second base member, wherein the rotatable axle extends between the first arm and the second arm.

15. The reel system of claim 12, wherein the actuatable input comprises a crank assembly having a crank arm and a handle coupled to the crank arm.

16. The reel system of claim 12, wherein the actuatable input comprises a motor including one or more of: a DC motor, an AC motor, a permanent magnet motor, an induction motor, or a brushless motor.

17. A reel system for receiving a leading edge of a flexible buoyant pad, the reel system comprising:

a base member;

an arm rotatably coupled to the base member;

a rotatable axle removably coupled to the arm, the rotatable axle is rotatable relative to the arm and adapted to support the flexible buoyant pad in a storage configuration when the flexible buoyant pad is rolled around the rotatable axle, the rotatable axle comprising:

a bracket having a first end and a second end, the bracket comprising a first extension and a second extension forming a right-angle bracket;

a first coupling plate coupled to the first end of the bracket;

a second coupling plate coupled to the second end of the bracket; and a rod having a rod first end coupled to the first coupling plate and a rod second end coupled to the second coupling plate, the rod spaced apart from the bracket to define an opening between the bracket and the rod, the opening configured to receive the leading edge of the flexible buoyant pad; and an actuatable input supported by the arm, the actuatable input configured to rotate the rotatable axle relative to the arm.

18. The reel system of claim 17, wherein the first coupling plate comprises an outer coupling point configured to rotatably couple to the arm and an inner coupling point coupled to the rod first end.

19. The reel system of claim 17, wherein the bracket further comprises a first endcap coupled to the first end and a second endcap coupled to the second end.

20. The reel system of claim 17, wherein the base member is a first base member and the arm is a first arm, the reel system further comprising a second base member, a second arm rotatably coupled to the second base member, wherein the first coupling plate is rotatably coupled to the first arm and the second coupling plate is rotatably coupled to the second arm.

21. The reel system of claim 17, further comprising a support coupled to the base member, the support being arcuately shaped and positioned to contact the flexible buoyant pad when the flexible buoyant pad is rolled around the rotatable axle.

22. The reel system of claim 17, wherein the rotatable axle is removably coupled to the arm via a coupling mechanism including one or more of: a pin-and-slot system or a latching mechanism.

* * * * *